US005853966A

United States Patent [19]

Murayama

[11] Patent Number: 5,853,966

[45] Date of Patent: Dec. 29, 1998

[54] SILVER HALIDE PHOTOGRAPHIC MATERIAL

[75] Inventor: Masahiko Murayama, Kanagawa, Japan

[73] Assignee: Fuji Photo Film Co., Ltd., Kanagawa, Japan

[21] Appl. No.: 685,617

[22] Filed: Jul. 24, 1996

[30] Foreign Application Priority Data

Jul. 28, 1995 [JP] Japan ..... 7-211303

[51] Int. Cl.[6] ..... G03C 11/06; G03C 1/95

[52] U.S. Cl. ..... 430/501; 430/950; 430/523; 430/496; 430/140

[58] Field of Search ..... 430/950, 496, 430/523, 501, 140

[56] References Cited

U.S. PATENT DOCUMENTS

| | | | |
|---|---|---|---|
| 4,142,894 | 3/1979 | Hori et al. | 430/950 |
| 4,447,525 | 5/1984 | Vallarino et al. | 430/539 |
| 5,370,982 | 12/1994 | Tashiro et al. | 430/529 |
| 5,441,860 | 8/1995 | Fornasari et al. | 430/537 |
| 5,550,011 | 8/1996 | Fant et al. | 430/496 |
| 5,580,707 | 12/1996 | Kawamoto | 430/496 |
| 5,595,862 | 1/1997 | Fant et al. | 430/537 |
| 5,738,983 | 4/1998 | Smith et al. | 430/536 |
| 5,753,425 | 5/1998 | Vandenabeele et al. | 430/496 |

FOREIGN PATENT DOCUMENTS

| | | | |
|---|---|---|---|
| 0 610 522 A1 | 8/1994 | European Pat. Off. | G03C 1/95 |
| 0 618 490 A1 | 10/1994 | European Pat. Off. | G03C 1/95 |

*Primary Examiner*—Mark F. Huff

*Attorney, Agent, or Firm*—Sughrue, Mion, Zinn, MacPeak & Seas PLLC

[57] ABSTRACT

A silver halide photographic material is disclosed, comprising a support having thereon at least one silver halide emulsion layer, wherein the photographic material contains a polymer having a number average grain size of from 0.3 to 10 $\mu$m and a variation coefficient thereof of 0.40 or less and containing from 5 to 15 mol % of an acid monomer.

11 Claims, No Drawings

SILVER HALIDE PHOTOGRAPHIC MATERIAL

FIELD OF THE INVENTION

The present invention relates to a silver halide photographic material and, in particular, to a silver halide photographic material having excellent development processing suitability.

BACKGROUND OF THE INVENTION

In recent years, as disclosed in JP-A-4-68336 (the term "JP-A" as used herein means an "unexamined published Japanese patent application") and JP-A-4-73737, a photographic material of the type which is preserved in a cartridge in a long roll as it is after development processing has appeared. As a result, it has further become necessary to prevent blocking of film surfaces each other. Monodisperse matting agents for preventing blocking are disclosed in JP-A-61-230141 and EP-A-618490.

Recently, high speed development processing has been conducted in development labs for shortening the development processing time.

However, when a photographic material containing a matting agent of a type which does not dissolve in development processing is transported by a high speed processor, such a problem has arisen that a matting agent is peeled off when passing through a liquid squeezing device comprising two sheets of rubber plate (called rubber lips) installed between tanks of a processor. Also, it has been found that, in particular, grain size distribution of conventionally used matting agents is broad and those having large grain size have selectively brought about peeling off accident.

SUMMARY OF THE INVENTION

Accordingly, an object of the present invention is to provide a silver halide photographic material whose insoluble matting agent incorporated into the uppermost layer does not peel off when the photographic material is processed by a high speed processor for a motion picture film.

This object of the present invention has been achieved by a silver halide photographic material comprising a support having thereon at least one silver halide emulsion layer, wherein the photographic material contains a polymer having a number average grain size of from 0.3 to 10 $\mu$m and a variation coefficient thereof of 0.40 or less and containing from 5 to 15 mol % of an acid monomer.

DETAILED DESCRIPTION OF THE INVENTION

In the first place, the matting agent of the present invention is described. The matting agent of the present invention is a matting agent having a number average grain size of from 0.3 $\mu$m to 10 $\mu$m, a variation coefficient thereof of 0.40 or less and is insoluble in a development processing solution. The variation coefficient used herein is a value obtained by dividing the standard deviation of the grain sizes of the entire grains by the average grain size. The number average grain size of the matting agent is preferably from 1.0 $\mu$m to 8 $\mu$m, more preferably from 1.5 $\mu$m to 6 $\mu$m, still more preferably from 1.5 $\mu$m to 4 $\mu$m, and most preferably from 1.5 $\mu$m to 2.9 $\mu$m. The variation coefficient in number average grain size of the matting agent is preferably 0.30 or less, more preferably 0.20 or less, and most preferably 0.10 or less. The lower limit of the variation coefficient is preferably 0.05. If the variation coefficient is too large, coarse grains are mixed and the above-described peeling off is liable to occur. Further, the number average grain size and the grain size distribution in the present invention can be obtained by taking the electron microphotograph of the matting agent and from which selecting at random and measuring 500 or more grain sizes of the matting agent.

The amount contained of the matting agent is preferably from 2 to 300 mg/m$^2$, more preferably from 5 to 200 mg/m$^2$, and still more preferably from 10 to 100 mg/m$^2$. If the number average grain size is less than 0.3 $\mu$m, an adhesion-resisting effect is reduced, on the contrary, if it is larger than 10 $\mu$m, graininess of the photograph and coating property are deteriorated. Further, if the content of the matting agent is less than 2 mg/m$^2$, the adhesion-resisting effect after processing is also reduced, and if it is more than 300 mg/m$^2$, the transparency of the photographic material after development processing is deteriorated.

The high molecular compound used as a matting agent preferably has glass transition temperature (Tg) of 40° C. or more, more preferably 50° C. or more, and still more preferably 60° C. or more. If the glass transition temperature is lower than 40° C., the blocking property under atmospheric temperature of 40° C. or more is deteriorated, which is not preferred.

Further, the refractive index of the matting agent of the present invention is preferably ±0.5 or less of that of the binder in the layer containing the matting agent. The refractive index of the matting agent of the present invention preferably approximates that of the binder in the layer containing the matting agent, if possible, preferably within ±0.4 or less, more preferably within ±0.3 or less, still more preferably within ±0.2 or less, and particularly preferably within ±0.1 or less, of the refractive index of the binder. It is not preferred for the refractive index of the matting agent of the present invention to deviate the range of within ±0.5 of the refractive index of the binder in the layer containing the matting agent because the transparency and graininess of the photographic material are extremely deteriorated. The matting agent of the present invention can be used in admixture of two or more. High molecular compounds synthesized by a soap free polymerization method and a suspension polymerization method, and high molecular compounds which are made spherical by a spray dry method or a dispersion method can be used as a matting agent in the present invention. Further, the method disclosed in JP-A-61-230141 is also preferably used.

The matting agent of high molecular compounds of the present invention is a copolymer comprising an acid monomer and at least one or more nonionic monomers.

Examples of acid monomers include acrylic acid, methacrylic acid, itaconic acid, maleic acid, styrenesulfonic acid, vinylbenzylsulfonic acid, vinylsulfonic acid, acryloyloxyalkylsulfonic acid (e.g., acryloyloxymethylsulfonic acid); methacryloyloxyalkylsulfonic acid (e.g., methacryloyloxyethylsulfonic acid); acrylamidoalkylsulfonic acid (e.g., 2-acrylamido-2-methylethanesulfonic acid); methacrylamidoalkylsulfonic acid (e.g., 2-methacrylamido-2-methylethanesulfonic acid); and acryloyloxyalkylphosphate (e.g., acryloyloxyethylphosphate). These acids may be salts of alkali metal (e.g., Na, K) or ammonium ion.

Acrylic acid and methacrylic acid are preferred, and methacrylic acid is particularly preferred.

The amount contained of the acid monomer is from 5 to 15 mol %, and preferably from 7 to 12 mol %, of the entire monomers. If an acid component is contained in an amount of more than 15 mol %, it is dissolved during development processing, while when it is less than 5 mol %, the matting agent is peeled off by rubber lips of a processor for a motion picture film.

Examples of nonionic monomers copolymerized with acid monomers include acrylic acid esters, methacrylic acid esters, itaconic acid diesters, crotonic acid esters, maleic acid diesters, and phthalic acid diesters, and examples of ester residues thereof include methyl, ethyl, propyl, isopropyl, butyl, hexyl, 2-ethylhexyl, 2-chloroethyl, cyanoethyl, 2-acetoxyethyl, dimethylaminoethyl, benzyl, cyclohexyl, furfuryl, phenyl, 2-hydroxyethyl, 2-ethoxyethyl, glycidyl, and ω-methoxypolyethylene glycol (addition mol number: 9).

In addition to the above, vinyl esters, olefins, styrenes, acrylamides, methacrylamides, allyl compounds, vinyl ethers, vinyl ketones, vinyl heterocyclic compounds, and unsaturated nitriles can also be used.

Further, examples of those usable include monoalkyl itaconate (e.g., monoethyl itaconate); monoalkyl maleate (e.g., monomethyl maleate), and crosslinkable monomers such as N-(2-acetoacetoxyethyl)acrylamide, N-[2-(2-acetoacetoxyethoxy)ethyl]acrylamide, divinylbenzene, and ethylene glycol dimethacrylate.

Of these monomers, acrylic acid esters, methacrylic acid esters, vinyl esters, styrenes and olefins are preferably used, among these, methyl methacrylate and ethyl methacrylate are more preferred, and a methyl methacrylate/methacrylic acid copolymer is most preferred.

Further, the grains having a fluorine atom or a silicon atom as disclosed in JP-A-62-14647, JP-A-62-17744 and JP-A-62-17743 may be used in the present invention.

Particularly preferred matting agents for use in the present invention are matting agents containing total of acrylic acid and esters thereof and methacrylic acid and esters thereof as matting agent components in an amount of 80 wt % or more.

In such a case, vinyl esters, olefins, styrenes, acrylamides, methacrylamides, allyl compounds, vinyl ethers, vinyl ketones, vinyl heterocyclic compounds or unsaturated nitrites can be used in an amount of 20 wt % or less in weight ratio. Preferred are styrenes and styrene derivatives.

The preferred embodiments of the matting agents of high molecular compounds of the present invention are a methyl methacrylate/acrylic acid copolymer (95/5 to 85/15 (mol ratio)), a methyl methacrylate/methacrylic acid copolymer (95/5 to 85/15 (mol ratio)), and an ethyl methacrylate/methacrylic acid copolymer (95/5 to 85/15 (mol ratio)), and more preferred are a methyl methacrylate/acrylic acid copolymer (93/7 to 88/12 (mol ratio)), a methyl methacrylate/methacrylic acid copolymer (93/7 to 88/12 (mol ratio)), an ethyl methacrylate/methacrylic acid copolymer (93/7 to 88/12 (mol ratio)) and a styrene/methacrylic acid copolymer (95/5 to 85/15 (mol ratio)).

Specific examples of matting agents for use in the present invention are shown below, but the present invention is not limited thereto.

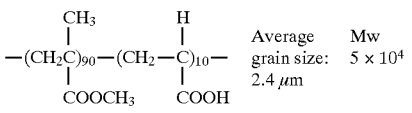

Average grain size: 2.4 μm Mw $5 \times 10^4$ M-1

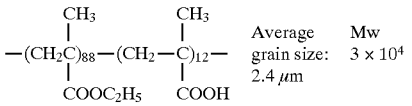

Average grain size: 2.4 μm Mw $3 \times 10^4$ M-2

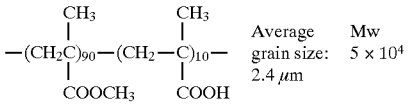

Average grain size: 2.4 μm Mw $5 \times 10^4$ M-3

-continued

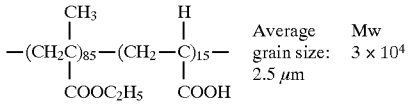

Average grain size: 2.5 μm Mw $3 \times 10^4$ M-4

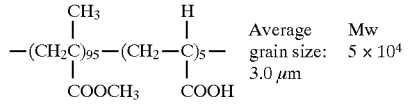

Average grain size: 3.0 μm Mw $5 \times 10^4$ M-5

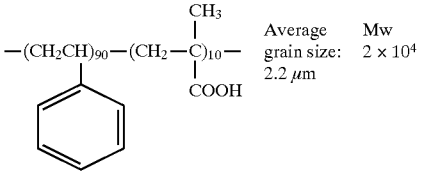

Average grain size: 2.2 μm Mw $2 \times 10^4$ M-6

The monodisperse matting agent of the present invention may be dispersed as it is when the polymer contains water-insoluble solvents or may be dispersed in water after being dissolved in an appropriate solvent, or classified and monodispersed after polymerization, as well as direct polymerization of vinyl monomers.

Examples of monodispersion method due to a polymerization method include well-known methods such as a soap free polymerization method, a suspension polymerization method, a nozzle vibrating method, a swelling seed method, a molecular diffusion method, a two-stage swelling method, a dynamic swelling method, an accelerated diffusion polymerization method, or a dispersion polymerization method.

In addition to the matting agent of the present invention, a matting agent which is dissolved by alkali treatment or fine grains comprising organic and inorganic compounds having a grain size of 0.5 μm or less may be contained. As matting agents dissolved by alkali treatment, those in which acid components are contained in an amount of from 40 to 60 mol %, preferably from 43 to 47 mol %, of the above-described components of the matting agents are preferred. Specific examples of the compounds include a methyl methacrylate/acrylic acid copolymer (60/40 to 40/60 (mol ratio)) and a methyl methacrylate/methacrylic acid copolymer (60/40 to 40/60 (mol ratio)), and more preferred of these are a methyl methacrylate/acrylic acid copolymer (57/43 to 53/47 (mol ratio)) and a methyl methacrylate/methacrylic acid copolymer (57/43 to 53/47 (mol ratio)). The grain size distribution of these matting agents of the type dissolved by alkali treatment may be broad or sharp.

Moreover, the fine grains are preferably alkali-insoluble, and these fine grains have the effects of preventing the matting agent of the present invention from sinking in the film constituting the light-sensitive layer under high temperature and high humidity conditions and improving blocking property.

The content of these fine grains is from 0.1 to 2,000 mg/m$^2$, preferably from 1 to 1,500 mg/m$^2$, more preferably from 10 to 1,000 mg/m$^2$, and still more preferably from 5 to 500 mg/m$^2$. These fine grains may be inorganic or organic compounds, or may have the same compositions as the above-described matting agents of the present invention. These fine grains can be used in admixture of two or more. When the major component of the binder of the layer in which these fine grains are contained is gelatin, these grains are preferably silicon dioxide (silica) and high molecular compounds. Among these, silica and high molecular compounds obtained from monomer compounds of acrylic acid esters, methacrylic acid esters, vinyl esters, styrenes, and olefins are preferred. Examples of grains of high molecular compounds which are preferably used in the present invention include, for example, polystyrene, polymethyl (meth) acrylate, polyethyl acrylate, poly(methyl methacrylate/acrylic acid=90/10 (mol ratio)), poly(styrene/acrylic acid=95/5 (mol ratio)), poly(methyl methacrylate/methacrylic acid=90/10 (mol ratio)), poly(styrene/styrenesulfonic acid=95/5 (mol ratio)), polyacrylonitrile, and poly(methyl methacrylate/ethyl acrylate/methacrylic acid=50/40/10 (mol ratio)).

The binder of the layer in which the matting agent of the present invention is contained may be any polymer provided that it has a hydrophilic group, but gelatin is most preferred. Gelatin may be any gelatin, for example, alkali-processed (lime-processed) gelatin which is immersed in an alkali bath before extraction of gelatin during manufacture, acid-processed gelatin which is immersed in an acid bath, double immersed gelatin which is subjected to both of these processes, or enzyme-processed gelatin. In particular, gelatin having high jelly strength is often preferably used. If necessary, gelatin may be used in combination partially with cellulose derivatives such as colloidal albumin, casein, carboxymethyl cellulose or hydroxyethyl cellulose, sugar derivatives such as agar, sodium alginate, starch derivatives or dextran, or synthetic hydrophilic colloid such as polyvinyl alcohol, poly-N-vinyl pyrrolidone, a polyacrylic acid copolymer, polyacrylamide or derivatives of these compounds, partially hydrolyzed products, or gelatin derivatives.

It is preferred that the hydrophilic binder layer containing the matting agent of the present invention and the above-described fine grains are hardened. Examples of hardening agents include aldehyde compounds such as formaldehyde and glutaraldehyde, ketone compounds such as diacetyl and cyclopentanediol, bis-(2-chloroethylurea), 2-hydroxy-4,6-dichloro-1,3,5-triazine, the compounds having a reactive halogen disclosed in U.S. Pat. Nos. 3,288,775 and 2,732,303, and British Patents 974,723 and 1,167,207, divinyl sulfone, 5-acetyl-1,3-diacryloylhexahydro-1,3,5-triazine, the compounds having a reactive olefin disclosed in U.S. Pat. Nos. 3,635,718 and 3,232,763 and British Patent 994,869, N-hydroxymethylphthalimide, the N-methylol compounds disclosed in U.S. Pat. Nos. 2,732,316 and 2,588,168, the isocyanates disclosed in U.S. Pat. No. 3,103,437, the aziridine compounds disclosed in U.S. Pat. Nos. 3,017,280 and 2,983,611, the acid derivatives disclosed in U.S. Pat. Nos. 2,725,294 and 2,725,295, the epoxy compounds disclosed in U.S. Pat. No. 3,091,537, and halogenocarboxy aldehydes such as mucochloric acid. Examples of inorganic hardening agents include chromium alum, zirconium sulfate, and the carboxyl group activation type hardening agents disclosed in JP-B-56-12853 (the term "JP-B" as used herein means an "examined Japanese patent publication") and JP-B-58-32699, Belgian Patent 825,726, JP-A-60-225148 and JP-A-51-126125, JP-B-58-50699, JP-A-52-54427 and U.S. Pat. No. 3,321,313.

The amount used of a hardening agent is generally from 0.01 to 30 wt %, and preferably from 0.05 to 20 wt %, based on the binder.

The layer in which the matting agent described above is included can contain, if necessary, various additives such as a lubricating agent, a surfactant, an antistatic agent, a thickener, an ultraviolet absorber, silver halide and a formaldehyde scavenger.

The support for use in the present invention is described below. The support for use in the present invention may be any support as long as it can be used as a photographic film, for example, triacetate cellulose, but a polyester is particularly preferred. The polyester of the present invention comprises diol and dicarboxylic acid as major components.

Examples of preferred aromatic dicarboxylic acids include 2,6-naphthalenedicarboxylic acid (NDCA), 1,5-NDCA, 1,4-NDCA, 2,7-NDCA, terephthalic acid (TPA), isophthalic acid (IPA), orthophthalic acid (OPA), and p-phenylenedicarboxylic acid (PPDC), and examples of diols include (polyethylene glycol (PEG or EQ), cyclohexanedimethanol (CHDM), neopentyl glycol (NPG), bisphenol A (BPA) and biphenol (BP).

Among these, polyesters containing 2,6-naphthalenedicarboxylic acid are preferred. Specifically, polyesters containing 10 mol % or more, preferably 50 mol % or more, and still more preferably 70 mol % or more, of 2,6-naphthalenedicarboxylic acid in the entire dicarboxylic acid are preferred. Particularly preferred, among these, is polyethylene-2,6-naphthalate.

These homopolymers and copolymers can be synthesized by conventionally well-known producing methods of polyesters. For example, in the case when an acid component is to be directly esterification-reacted with a glycol component, or in the case when dialkyl esters are used as an acid component, they can be synthesized in the first place by transesterificating the acid component with the glycol component, and removing excessive glycol component while heating under reduced pressure. Also, an acid component may previously be made to be acid halide and then reacted with glycol, and at this time, a transesterification, a catalyst, or a catalyst for polymerization reaction may be used, or a heat resisting stabilizer may be added, if necessary. Synthesis of these polyesters can be carried out with reference to the methods disclosed in *Kobunshi Jikkenqaku* (*High Polymer Experimentation*), Vol. 5, "Jushukugo to Jufuka (Polycondensation and Polyaddition" (Kyoritsu Shuppan, 1980), pages 103 to 136, *Gosei Kobunshi V* (*Synthetic High Polymer V*), (Asakura Shoten, 1971), pages 187 to 286.

With respect to the preferred average molecular weight of these polyesters, the limiting viscosity measured in o-chlorophenol at 35° C. is from 0.35 to 1.0, preferably from 0.5 to 0.75 (g/dl). The preferred Tg of the polyesters for use in the present invention is from 50° C. to 200° C.

Specific examples of preferred polyester compounds which can be used in the present invention are shown below, however, the present invention is not limited thereto.

| | | |
|---|---|---|
| P-0: | [Terephthalic acid (TPA)/ethylene glycol (EG) (100/100)](PET) | Tg = 80° C., (η) = 0.70 |
| P-1: | [2,6-Naphthalenedicarboxylic acid (NDCA)/ethylene glycol (EG) (100/100)](PEN) | Tg = 119° C., (η) = 0.62 |
| P-2: | [Terephthalic acid (TPA)/cyclohexanedimethanol (CHDM) (100/100)] | Tg = 93° C., (η) = 0.55 |
| P-3: | [TPA/bisphenol A (BPA) (100/100)] | Tg = 192° C., (η) = 0.48 |

The thickness of these polyester supports is from 50 to 300 μm. They are preferably thicker in view of their strength, more preferably from 50 to 200 μm, still more preferably from 80 to 115 μm, and particularly preferably from 85 to 105 μm.

The polyester support is necessary to be heat-treated at a temperature of Tg to Tg minus 50° C., generally at 40° C. or more to less than Tg, and more preferably at Tg minus 20° C. or more to less than Tg.

The heat treatment may be conducted at a constant temperature within this range or may be carried out with cooling. The average cooling rate is preferably from −0.01° to −20° C./hour, and more preferably −0.1° to −5° C./hour.

The heat treatment time is preferably from 0.1 hours to 1,500 hours, and more preferably from 0.5 hours to 200 hours.

For enhancing the effect for improving curling habit when the support is preserved in a cartridge, it is preferred to conduct a heat treatment at a temperature of Tg or more to less than a melting point (the melting temperature obtained by DSC) before carrying out the above-described heat treatment to eliminate the heat history of the support, then heat treatment at 40° C. or more to less than Tg is carried out again.

In the present invention, this heat treatment is called "pre-heat treatment" and differentiated from the above-described heat treatment at 40° C. or more to less than Tg, which is called "post-heat treatment".

The pre-heat treatment is preferably carried out at Tg or more to less than a melting point, more preferably from Tg plus 20° C. to a crystallization temperature (the crystallization temperature obtained by DSC).

The pre-heat treatment time is preferably from 0.1 minutes to 1,500 hours, and more preferably from 1 minute to 1 hour.

The post-heat treatment is carried out after this pre-heat treatment. The temperature at the termination of the pre-heat treatment may be forcedly cooled to the starting temperature of the post-heat treatment, may be gradually cooled to the starting temperature of the post-heat treatment passing Tg, or the temperature may be once cooled to room temperature, then raised to the temperature of the post-heat treatment.

A couple of combinations of the pre-heat treatment and post-heat treatment methods are available but it is preferred that after the pre-heat treatment is conducted at a constant temperature in the range of from Tg plus 20° C. to crystallization temperature, post-heat treatment is carried out with cooling to the range of from Tg to Tg minus 20° C. at a cooling rate of from −0.1° to −5° C./hour.

The heat treatment of the support may be carried out in a roll state or may be carried out in a web state while transporting.

For further heighten the function as photographic supports, ultraviolet absorbers may be incorporated into the polyester supports of the present invention for the purpose of fluorescence prevention and for providing the stability with the lapse of time. Further, dyes for preventing the so-called light piping may be added. Also, the addition of inert inorganic compounds such as $SiO_2$, $TiO_2$, $BaSO_4$, $CaCO_3$, talc or kaolin, or coating of surfactants may be conducted for providing the polyester supports with slipperiness.

In the case of using these polyester films as a support, it is very difficult to strongly adhere photographic layers (e.g., a light-sensitive silver halide emulsion layer, an interlayer, a filter layer, etc.) comprising protective colloid, which comprises mainly gelatin, on a support because the surfaces of these polyester films are each hydrophobic. It is preferred to conduct at least one of an ultraviolet irradiation treatment, a flame treatment, a corona discharge treatment and a glow discharge treatment to cope with these difficulties.

The photographic layers of the photographic material of the present invention are described below.

The silver halide emulsion layer may be either for a black-and-white or color photographic material. Herein, a silver halide color photographic material is explained.

The photographic material of the present invention may comprise at least one blue-sensitive layer, green-sensitive layer or red-sensitive layer on a support, and there are no limitations with respect to the number and the order of silver halide emulsion layers and light-insensitive layers. In a typical embodiment, the silver halide photographic material of the present invention comprises at least one light-sensitive layer consisting of a plurality of silver halide emulsion layers having substantially the same color sensitivity but different degrees of light-sensitivity on a support. The light-sensitive layer is a unit light-sensitive layer having a color sensitivity to any of blue light, green light and red light. In the multilayered silver halide color photographic material, these unit light-sensitive layers are generally arranged in the order of red-sensitive layer, green-sensitive layer and blue-sensitive layer from the support side. However, the order of arrangement can be reversed depending on the purpose, alternatively, the light-sensitive layers may be arranged in such a way that a layer having a different color sensitivity is interposed between layers having the same color sensitivity.

Light-insensitive layers such as interlayers may be provided between the above-described silver halide light-sensitive layers, and in the uppermost layer and in the lowermost layer of the silver halide light-sensitive layers.

These light-insensitive layers may contain the couplers, DIR compounds and color mixing preventives as disclosed in JP-A-61-43748, JP-A-59-113438, JP-A-59-113440, JP-A-61-20037 and JP-A-61-20038.

The plurality of silver halide emulsion layers constituting each unit light-sensitive layer are disclosed in West German Patent 1,121,470, British Patent 923,045, JP-A-57-112751, JP-A-62-200350, JP-A-62-206541, JP-A-62-206543, JP-A-56-25738, JP-A-62-63936, JP-A-59-202464, JP-B-55-34932 and JP-B-49-15495.

The silver halide grains may have a regular crystal form such as a cubic, octahedral or tetradecahedral form, an irregular crystal form such as a spherical or plate-like form, a form which has crystal defects such as twin crystal planes, or a form which is a composite of these forms.

The silver halide grains may be fine grains having a grain size of about 0.2 μm or less, or large size grains having a projected area diameter of up to about 10 μm, and the emulsion may be a polydisperse emulsion or a monodisperse emulsion.

The silver halide photographic emulsions for use in the present invention can be prepared using the methods disclosed, for example, in *Research Disclosure* (hereinafter abbreviated to *RD*), No. 17643 (December, 1978), pages 22 and 23, "I. Emulsion Preparation and Types" *RD* No. 18716 (November, 1979), page 648, P. Glafkides, *Chimie et Physique Photographique*, Paul Montel (1967), G. F. Duffin, *Photographic Emulsion Chemistray*, Focal Press (1966), and V. L. Zelikman et al., *Making and Coating Photographic Emulsion*, Focal Press (1964).

The monodisperse emulsions disclosed in U.S. Pat. Nos. 3,574,628, 3,655,394 and British Patent 1,413,748 are also preferred.

Further, tabular grains having an aspect ratio of about 5 or more can also be used in the present invention. Tabular grains can be easily prepared according to the methods disclosed, for example, in Gutoff, *Photographic Science and Engineering*, Vol. 14, pages 248 to 257 (1970), U.S. Pat. Nos. 4,434,226, 4,414,310, 4,433,048, 4,439,520 and British Patent 2,112,157.

The crystal structure may be uniform, or the interior and exterior parts of the grains may have different halogen compositions, or the grains may have a layered structure. Further, silver halides which have different compositions may be joined with an epitaxial junction or may be joined with compounds other than a silver halide, such as silver thiocyanate or lead oxide.

Mixtures of grains which have various crystal forms may also be used.

The silver halide emulsion for use in the present invention is usually subjected to physical ripening, chemical ripening and spectral sensitization. The effect of the present invention is particularly conspicuously exhibited when the emulsions sensitized with gold compounds and sulfur-containing compounds are used. Additives for use in such processes are disclosed in *RD*, No. 17643 and *RD*, No. 18716 and the locations of these disclosures are summarized in a table below.

Conventionally known photographic additives which can be used in the present invention are disclosed in the above two *Research Disclosures*, and the related locations of the disclosures are shown in the table below.

| | Type of Additives | RD 17643 | RD 18716 |
|---|---|---|---|
| 1. | Chemical Sensitizers | page 23 | page 648, right column |
| 2. | Sensitivity Increasing Agents | — | page 648, right column |
| 3. | Spectral Sensitizers and Supersensitizers | pages 23–24 | page 648, right column to page 649, right column |
| 4. | Brightening Agents | page 24 | — |
| 5. | Antifoggants and Stabilizers | pages 24–25 | page 649, right column |
| 6. | Light Absorbers, Filter Dyes, and Ultraviolet Absorbers | pages 25–26 column | page 649, right column to page 650, left |
| 7. | Antistaining Agents | page 25, right column | page 650, left to right columns |
| 8. | Dye image Stabilizers | page 25 | — |
| 9. | Hardening Agents | page 26 | page 651, left column |
| 10. | Binders | page 26 | page 651, left column |
| 11. | Piasticizers and Lubricants | page 27 | page 650, right column |
| 12. | Coating Aids and Surfactants | pages 26–27 | page 650, right column |

Further, it is preferred for the photographic material to contain the compounds which react with and fix formaldehyde as disclosed in U.S. Pat. Nos. 4,411,987 and 4,435,503 for preventing deterioration of the photographic characteristics due to formaldehyde gas.

Various color couplers can be used in the present invention, and specific examples are disclosed in the patents cited in the above *Research Disclosure*, No. 17643, VII-C to G.

The backing layer of the photographic material for use in the present invention is described below.

The backing layer of the photographic material of the present invention can contain various compounds, such as sliding agents for smooth getting in and out of a cartridge, antistatic agents for preventing adhesion of dusts, matting agents for preventing adhesion, and the magnetic substances and abrasives constituting a transparent magnetic recording layer disclosed in JP-A-4-68336, JP-A-4-73738 and JP-A-6-59357.

Examples of the magnetic grains for use in the present invention include ferromagnetic iron oxide such as $\gamma$-$Fe_2O_3$ (FeOx, $4/3<x\leqq 3/2$), Co-containing ferromagnetic iron oxide such as Co-containing $\gamma$-$Fe_2O_3$ (FeOx, $4/3<x\leqq 3/2$), Co-containing magnetite, other Co-containing ferromagnetic iron oxide, Co-containing magnetite, ferromagnetic chromium dioxide, ferromagnetic metal, ferromagnetic alloy, and other ferrite such as hexagonal system Ba ferrite, Sr ferrite, Pb ferrite, and Ca ferrite, and solid solutions and ion substitution products thereof.

The shape of the grain may be any of an acicular shape, a granular shape, a spherical shape, a cubic shape, or a plate-like shape, but an acicular shape is preferred from electromagnetic characteristics. The grain size and the specific surface area are not particularly limited, but the specific surface area (SBET) is preferably 20 $m^2/g$ or more, and particularly preferably 30 $m^2/g$ or more. The grain size of acicular grains is preferably long axis: 0.01 to 0.8 $\mu$m, short axis: 0.005 to 0.4 $\mu$m, and the ratio of long axis to short axis: 100/1 to 2/1, more preferably long axis: 0.04 to 0.4 $\mu$m, short axis: 0.01 to 0.1 $\mu$m, and the ratio of long axis to short axis: 100/1 to 3/1.

The saturation magnetization ($\sigma_s$) of the ferromagnetic powder is preferably larger, and is preferably 50 emu/g or more, and more preferably 70 emu/g or more. The squareness ratio ($\sigma r/\sigma s$) of the ferromagnetic powder is 40% or more, and preferably 45% or more. If the coercive force (Hc) is too small, the recorded information is liable to be erased, on the contrary, if too large, writing is sometimes impossible depending on the system to be used. Accordingly, appropriate value is preferred, generally from 200 Oe to 3,000 Oe, and preferably from 500 Oe to 2,000 Oe.

The ferromagnetic grains may be surface treated with silica and/or alumina such as those disclosed in JP-A-59-23505 'and JP-A-4-96052. The ferromagnetic grains may also be surface treated with inorganic and/or organic materials such as those disclosed in JP-A-4-195726, JP-A-4-192116, JP-A-4-259911 and JP-A-5-81652. Further, the surfaces of the ferromagnetic grains may be treated with a silane-coupling agent or a titanium coupling agent.

The binders preferably used for the magnetic grains of the present invention are described below.

The binders for use in the present invention includes well-known thermoplastic resins, thermosetting resins, radiation curable resins, reactive type resins, acid-, alkali- or biodegradable polymers, natural polymers (e.g., cellulose derivatives, sugar derivatives), and mixtures thereof.

Examples of thermoplastic resins include cellulose derivatives such as nitrocellulose, cellulose diacetate, cellulose triacetate, cellulose acetate propionate, cellulose acetate butyrate, cellulose tripropionate, and cellulose dodecanoate resins. Cellulose diacetate is preferred of these binders.

The binder is used alone or as a mixture of several kinds and can be subjected to curing treatment by adding epoxy based, aziridine based or isocyanate based known crosslinking agent, and/or radiation curable vinyl based monomers.

Examples of the isocyanate based crosslinking agents include polyisocyanate compounds having two or more isocyanate groups, for example, isocyanates, e.g., tolylenediisocyanate, 4,4'-diphenylmethanediisocyanate, hexamethylenediisocyanate, xylylenediisocyanate, naphthylene-1,5-diisocyanate, o-toluidinediisocyanate, isophoronediisocyanate, and triphenylmethanediisocyanate, reaction products of these isocyanates with polyalcohols (e.g., a reaction product of 3 mol of tolylenediisocyanate with 1 mol of trimethylolpropane), and polyisocyanate formed by condensation of these isocyanates.

Further, hydrophilic binders can also be used in the magnetic recording layer of the present invention. Gelatin is preferably used as hydrophilic binder.

The thickness of a magnetic recording layer is from 0.1 μm to 10 μm, preferably from 0.2 μm to 5 μm, and more preferably from 0.3 μm to 3 μm.

The weight ratio of the magnetic grains to the binder is preferably from 0.5/100 to 60/100, and more preferably from 1/100 to 30/100.

The coating amount of the magnetic grains is from 0.005 to 3 $g/m^2$, preferably from 0.01 to 2 $g/m^2$, and more preferably from 0.02 to 0.5 $g/m^2$.

The coercive force of the film coated with a magnetic recording layer is from 500 Oe to 3,000 Oe, and preferably from 800 Oe to 1,500 Oe.

The increase of the color density by coating a magnetic recording layer is necessary to be suppressed as low as possible. It is preferred that the increase of blue filter density is 0.5 or less, and preferably 0.2 or less.

Inorganic and organic fine grains (e.g., silica, $SiO_2$, $SnO_2$, $Al_2O_3$, $TiO_2$, crosslinked polymethyl methacrylate, barium carbonate, silicon fine grains) are preferably added to a backing layer.

The grains added are insoluble in a development processing solution, and inorganic fine grains, polymer grains, and crosslinked polymer grains can be used as such grains. Examples of inorganic grains for use in the present invention include inorganic fine powders, e.g., barium sulfate, manganese colloid, titanium dioxide, strontium barium sulfate, and silicon dioxide, and further, silicon dioxide such as synthetic silica obtained by a wet method or gelation of silicic acid, and titanium dioxide formed by titanium slag and sulfuric acid (a rutile type and an anatase type). Further, inorganic grains obtained by pulverizing inorganic materials having a comparatively large grain size, e.g., 20 μm or more, and classifying (vibrating filtration and air separation) can also be used.

Examples of high molecular compounds include polytetrafluoroethylene, cellulose acetate, polystyrene, polymethyl methacrylate, polypropyl methacrylate, polymethyl acrylate, polyethylene carbonate, starch, and pulverized and classified products thereof. Further, grains for use in the present invention may be grains obtained by various means, e.g., suspension polymerizing, spray drying or dispersing high molecular compounds, that is, polymers comprising one or two or more monomers such as acrylic acid ester, methacrylic acid ester, itaconic acid diester, crotonic acid ester, maleic acid diester, phthalic acid diester, styrene derivatives, vinyl esters, acrylamides, vinyl ethers, aryl compounds, vinyl ketones, vinyl heterocyclic compounds, allyl compounds, acrylonitrile, methacrylonitrile, polyfunctional monomers, siloxane three dimensional polymers, benzoguanamine/formaldehyde condensation products, benzoguanamine/melamine/formaldehyde condensation products, or melamine/formaldehyde condensation products.

The average grain size of these grains is preferably from 0.1 μm to 1 μm and the coating amount thereof is preferably from 1 to 100 $mg/m^2$ so as not to deteriorate the photographic characteristics.

At least one kind or more of these grains are preferably non-spherical inorganic grains having Mohs' hardness of 5 or more.

The composition of the non-spherical inorganic grain is preferably oxide such as aluminum oxide (α-alumina, γ-alumina, corundum), chromium oxide ($Cr_2O_3$), iron oxide ($\alpha$-$Fe_2O_3$), silicon dioxide, titanium dioxide, silicon carbide (SiC), etc., carbide such as silicon carbide and titanium carbide, and fine powders such as diamond, and more preferably aluminum oxide and chromium oxide ($Cr_2O_3$). These grains may be added to a magnetic recording layer.

Further, antistatic agents are preferably used in the present invention. Antistatic agents are not particularly limited and examples of such antistatic agents include high polymers containing carboxylic acid and carboxylate, and sulfonate as anionic high polymer electrolyte, for example, the high polymers disclosed in JP-A-48-22017, JP-B-46-24159, JP-A-51-30725, JP-A-51-129216 and JP-A-55-95942. Examples of cationic high polymers include those disclosed in JP-A-49-121523, JP-A-48-91165 and JP-B-49-24582. Ionic surfactants include anionic and cationic surfactants and the compounds disclosed in JP-A-49-85826, JP-A-49-33630, U.S. Pat. Nos. 2,992,108 and 3,206,312, JP-A-48-87826, JP-B-49-11567, JP-B-49-11568, and JP-A-55-70837 can be cited.

The most preferred antistatic agents are fine grains of a crystalline metal oxide of at least one grain selected from ZnO, $TiO_2$, $SnO_2$, $Al_2O_3$, $In_2O_3$, $SiO_2$, MgO, BaO, $MoO_3$ and $V_2O_5$ or fine grains of these metals, further, fine grains of a metal oxide in the form of sol or fine grains of these metals.

The fine grains or acicular fillers of electrically conductive crystalline oxides or composite oxides thereof for use in the present invention have a volume resistivity of $10^7\Omega\cdot cm$ or less, more preferably $10^5\Omega\cdot cm$ or less, and a grain size of from 0.001 to 1.0 μm, particularly preferably from 0.001 to 0.3 μm. For giving further effective conductivity, it is preferred to use the fine grains or fillers of electrically conductive crystalline oxides or metals thereof whose first fine grains are partially agglomerated to a grain size of from 0.01 to 0.2 μm.

Further, when preparing an antistatic layer using these fine grains, the finally attained conductivity is preferably, both before and after processing, $10^{12}\Omega$ or less, more preferably $10^{10}\Omega$ or less, and particularly preferably $10^{9.5}\Omega$ or less, of electrical resistivity.

In this case, the addition amount to a photographic material is generally from 5 to 500 $mg/m^2$ and particularly preferably from 10 to 350 $mg/m^2$.

The amount of the binder is preferably from 1 to 500 $mg/m^2$ and particularly preferably from 5 to 300 $mg/m^2$. The ratio of the fine grains or acicular fillers of electrically conductive crystalline oxides or metals thereof to the binder is preferably from 1/300 to 100/1 and more preferably from 1/100 to 100/5.

Examples of the sliding agent which can be used in the present invention include, for example, the polyorganosiloxanes disclosed in JP-B-53-292, the higher fatty acid amides disclosed in U.S. Pat. No. 4,275,146, the higher fatty acid esters (esters of fatty acids having from 10 to 24 carbon atoms and alcohols having from 10 to 24 carbon atoms) disclosed in JP-B-58-33541, British Patent 927,446, JP-A-55-126238 and JP-A-58-90633, the higher fatty acid metal salts disclosed in U.S. Pat. No. 3,933,516, the straight chain higher fatty acid and straight chain higher alcohol esters disclosed in JP-A-58-50534, and the higher fatty acid containing a branched alkyl group and higher alcohol esters disclosed in WO 90108115.8.

Specific examples of the plastic materials for use in the present invention are shown below but the present invention is not limited thereto.

Specific examples include polystyrene, polyethylene, polypropylene, polymonochlorotrifluoroethylene, vinylidene chloride resins, vinyl chloride resins, vinyl chloride/vinyl acetate copolymer resins, acrylonitrile/butadiene/styrene copolymer resins, methyl methacrylic resins, vinyl formal resins, vinyl butyral resins, polyethylene terephthalate, Teflon, nylon, phenol resins, and melamine resins.

Particularly preferred plastic materials in the present invention are polystyrene, polyethylene, polypropylene, etc. Further, the patrone for use in the present invention may contain various antistatic agents. Antistatic agents are not particularly limited, and carbon black, metal oxide grains, nonionic, anionic, cationic and betaine based surfactants or polymers can be preferably used. Such a patrone static prevented is disclosed in JP-A-1-312537 and JP-A-1-312538.

In particular, those having the resistivity of $10^{12}\Omega$ or less at 25° C., 25% RH are preferred.

Usually, plastic patrone is produced using plastics including carbon black or a pigment to impart light shielding.

The size of the patrone may be the size of the present as it is, or for miniaturizing a camera, it is effective that the diameter of the cartridge of 25 mm of the present size may be decreased to 22 mm or less, preferably from 20 mm to 14 mm.

The capacity of the case of the patrone is 30 $cm^3$ or less, preferably 25 $cm^3$ or less, and more preferably 20 $cm^3$ or less. The weight of the plastics used for the patrone and patrone case is from 1 g to 25 g, preferably from 5 g to 15 g.

The ratio of the content volume of the case of the patrone to the plastics used for the patrone and the case of the patrone is 4 to 0.7 and preferably 3 to 1.

In the case of the preferred patrone storing 135 size color photographic material of the present invention, the total weight of the plastics used for the patrone and the case of the patrone is generally from 1 g to 25 g, preferably from 5 g to 15 g. The shape of the patrone according to the present invention is not particularly limited.

Further, the patrone of the type of sending out a film by revolving a spool for use in the present invention is described below.

There is a photographic film patrone which is capable of loading to a camera even if the tip of the film is not pulled out of the patrone previously, moreover, the feeding structure of the camera can be simplified. The structure of this photographic film patrone is such that the tip of the film is encased in the body of the patrone and the tip of the film is sent to outside through the port of the patrone by revolving the axle of the spool in the feeding direction of the film.

The photographic film patrone disclosed in U.S. Pat. No. 4,834,306 (corresponding to JP-A-1-306845) has a structure such that freely rotatable flanges are provided at both ends of the spool axle on to which a film is wound and tongues projecting inwardly are provided at the periphery of the flanges. That is, the outermost periphery of the film is inserted into the inside of the tongues provided at the flanges, and the loosening of the outermost periphery of the film is prevented by these tongues. Open projections are provided at the position where the film turns to the port to transform flanges to broaden the interval between flanges. That is, open projections are always thrusting up the flanges near the port and the outermost periphery of the film inserted into the inside of the tongues provided at the flanges can escape from the tongues. Thus, the tip of the film is sent to outside through the port of the patrone by revolving the axle of the spool in the feeding direction of the film.

Further, the method of shading of the film outlet is arbitrary. A felt-like shading member called "teremp" may be provided as usual, or the film outlet may be molded as capable of opening and shutting and kept shutting except for necessary time. Moreover, the tip of the film is not necessarily positioned at the top of the film outlet, it is enough to be encased in the body of the patrone but is desirably encased inside of the film outlet.

The film patrone disclosed in JP-A-4-115251 (corresponding to U.S. Pat. No. 5,226,613) has a structure such that freely rotatable flanges are provided at both ends of the spool axle and tongues projecting inwardly provided at the periphery of the flanges which prevent the loosening of the outermost periphery of the film wound on to the above spool axle, the first regulating rib provided within the patrone which regulates the above flanges rotatable freely at an inclined angle to the spool axle, the second regulating rib provided within the patrone which regulates the limit of inclination of the flanges to the spool axle, and the width of the above film tip is made narrower than the distance between the tips of tongues, the stage difference between the side ends of the tip of the film and the side ends of the part where photographing is possible is formed to become easy curve, and this stage difference touches the tongues to thrust up the flanges at the time sending out the film.

Further, another patrone has a structure such that freely rotatable flanges are provided at both ends of the spool axle and tongues projecting inwardly provided at the periphery of the flanges prevent the loosening of the outermost periphery of the film wound on to the above spool axle, open projections are provided at the position where the film turns to the port to touch the tongues to transform flanges to broaden the interval between flanges, and the regulating rib provided within the patrone which regulates the above flanges rotatable freely at an inclined angle to the spool axle.

The photographic film for use in the present invention may be a so-called raw film before development or may be a photographic film development processed. Further, a raw film and a processed film may be contained in the same patrone, or may be stored in different patrones.

In particular, as a processed film is preserved for a long period of time, the size of the container is larger than the patrone for storing a raw film, the spool is easy to revolve and a shading constitution (e.g., teremp) is not necessarily required. In some cases, a new patrone is preferred to contain sufficient amounts of a sliding agent and an antistatic agent.

Further, a development processed photographic film may be added with a sliding agent and antistatic agent depending on the final bath or the coating method (e.g., a spraying method, a transfer method, a coating method) and encased in a new cartridge.

The present invention will be illustrated in more detail with reference to examples below, but these are not to be construed as limiting the invention.

EXAMPLE 1

1) Support

The support which was used in the present invention was prepared as follows.

100 weight parts of commercially available polyethylene-2,6-naphthalate polymer, 2 weight parts of Tinuvin P. 326 (produced by Ciba Geigy Co., Ltd.), as an ultraviolet absorber, and the necessary amounts of each of yellow, magenta and cyan dyes for preventing light piping were dried in an ordinary method, then melted at 300° C., subsequently, extruded through a T-type die, and stretched 3.3 times in a machine direction at 140° C. and then 3.3 times in a transverse direction at 130° C., and further thermal fixed for 6 seconds at 250° C. and the PEN film having the thickness of 90 pm (Tg=119° C.) was obtained.

Further, a part of the film was wound on to a stainless steel spool having a diameter of 20 cm and provided heat history at 110° C. for 48 hours.

2) Coating of Undercoat Layer

After both surfaces of the above support were subjected to glow discharge treatment with a cylindrical electrode at 3,000 w for 30 sec. irradiation, an undercoat layer solution having the following composition was coated on each side of the support and the undercoat layer was provided on the hotter side at the time of stretching.

| | |
|---|---|
| Gelatin | 3 g |
| Distilled Water | 25 cc |
| Sodium-α-sulfodi-2-ethylhexyl-succinate | 0.05 g |
| Formaldehyde | 0.02 g |
| Salicylic Acid | 0.1 g |
| Diacetyl Cellulose | 0.5 g |
| p-Chlorophenol | 0.5 g |
| Resorcin | 0.5 g |
| Cresol | 0.5 g |
| $(CH_2{=}CHSO_2CH_2NHCO)_2CH_2$ | 0.2 g |
| Trimethylolpropane Triazine | 0.2 g |
| Trimethylolpropanetristoluene-diisocyanate | 0.2 g |
| Methanol | 15 cc |
| Acetone | 85 cc |
| Formaldehyde | 0.01 g |
| Acetic Acid | 0.01 g |
| Concentrated Hydrochloric Acid | 0.01 g |

3) Coating of Backing Layer

On one side of the above support after undercoat layer coating, an antistatic layer, a magnetic recording layer and a sliding layer having the following compositions were coated as backing layers.

3-1) Coating of Antistatic Layer 3-1-1) Preparation of Electrically Conductive Fine Grain Dispersion Solution (Dispersion Solution of Stannic Oxide-Antimony Oxide Composite Metal Oxide)

230 weight parts of stannic chloride hydrate and 23 weight parts of antimony trichloride were dissolved in 3,000 weight parts of ethanol to obtain a homogeneous solution. A 1N aqueous sodium hydroxide solution was dropwise added to the above solution until the pH of the solution reached 3, thereby the coprecipitate of colloidal stannic oxide and antimony oxide was obtained. The thus-obtained coprecipitate was allowed to stand at 50° C. for 24 hours and red brown colloidal precipitate was obtained.

The red brown colloidal precipitate was isolated by a centrifugal separator. Water was added to the precipitate and water-washed by centrifugation to remove excessive ion. The excessive ion was removed by repeating this operation three times.

200 weight parts of the colloidal precipitate from which the excessive ion was removed was again dispersed in 1,500 weight parts of water, atomized in a kiln heated to 650° C., thereby bluish fine grain powder of a stannic oxide-antimony oxide composite having an average grain size of 0.005 μm was obtained. The specific resistance of this fine grain powder was 5 Ω·cm.

The pH of the mixed solution comprising 40 weight parts of the above fine grain powder and 60 weight parts of water was adjusted to 7.0. This mixed solution was dispersed coarsely by a stirrer, then dispersed using a horizontal sand mill ("Dyno Mill", manufactured by WILLYA. BACHOFENAG) until the residence time reached 30 minutes, thus the objective product was prepared. The average grain size of the second agglomerate was about 0.04 μm.

3-1-2) Coating of Electrically Conductive Layer

The following composition was coated on the support so as to the dry film thickness reached 0.2 μm and dried at 115° C. for 60 seconds.

| | |
|---|---|
| Electrically Conductive Fine Grain Dispersion Solution prepared in 3-1-1) | 20 weight parts |
| Gelatin | 2 weight parts |
| Water | 27 weight parts |
| Methanol | 60 weight parts |
| Resorcin | 2 weight parts |
| Polyoxyethylenenonylphenyl Ether | 0.01 weight parts |

3-2) Coating of Magnetic Recording Layer 220 g of water and 150 g of a silane coupling agent [3-(polyoxyethynyl)oxypropyltrimethoxysilane having the structural formula shown below (polymerization degree: 8)] were added to 1,100 g of magnetic substance [acicular, Co-containing γ-iron oxide (long axis: 0.2 μm, Hc: 830 Oe, $Fe^{2+}/Fe^{3+}$=6%)] and kneaded in an open kneader for 3 hours. This coarsely dispersed viscous solution was dried at 70° C. a whole day and night and the water was removed, then heat treated at 110° C. for 1 hour to prepare the surface treated magnetic grains.

Further, this product was again kneaded in the open kneader according to the following formulation.

| | |
|---|---|
| $(CH_3O)_3Si.CH_2CH_2CH_2O(CH_2CH_2O)_8CH_3$ | 1,000 g |
| The Above Surface Treated Magnetic Grains | |
| Diacetyl Cellulose | 17 g |
| Methyl Ethyl Ketone | 100 g |
| Cyclohexanone | 100 g |

Further, this product was finely dispersed by a sand mill (1/4 G) at 200 rpm for 4 hours according to the following formulation.

| | |
|---|---|
| The Above Kneaded Product | 100 g |
| Diacetyl Cellulose | 60 g |
| Methyl Ethyl Ketone | 300 g |
| Cyclohexanone | 300 g |

Further, diacetyl cellulose and $C_2H_5C[CH_2OCONH{-}C_6H_3(CH_3)NCO]_3$ as a hardening agent were added in an amount of 20 wt % based on the binder. This mixture was diluted with equal amounts of methyl ethyl ketone and cyclohexanone so that the obtained solution provided the viscosity of 80 cp. The solution was coated on the above electrically conductive layer using a bar coater to the film thickness of 1.2 μm. Coating was carried out so that the coating amount of the magnetic grains became 0.08 g/m$^2$. Silica grains (0.3 μm) as a matting agent and aluminum oxide (0.5 μm) as an abrasive were added each in an amount of 10 mg/m$^2$ Drying was conducted at 115° C. for 6 min (the roller and transporting apparatus of the drying zone were 115° C.).

3-3) Preparation of Sliding Layer

A sliding layer was prepared by coating the following composition so that the solid part of the coating amount became the following amounts, and dried at 110° C. for 5 min to prepare a sliding layer.

| | |
|---|---|
| Diacetyl Cellulose | 25 mg/m$^2$ |
| $C_6H_{13}(OH)C_7H_{15}COOC_{40}H_{81}$ (Compound 1) | 6 mg/m$^2$ |
| $C_{50}H_{101}O(CH_2CH_2O)_{16}H$ (Compound 2) | 9 mg/m$^2$ |

Compound (1) and Compound (2) were made dispersion in acetone (average grain size 0.02 μm) and then added.

4) Preparation of Light-Sensitive Layer 4-1) Preparation of Matting Agent

As an insoluble matting agent, an ethyl acetate/n-butanol=2/1 (wt) polymer solution (30 wt %) of poly(methyl methacrylate/methacrylic acid=90/10 (mol ratio)) was used. 0.4 weight parts of sodium dodecylbenzenesulfonate was added to 200 weight parts of a 12 wt % aqueous solution of gelatin and heated at 50° C. Subsequently, 100 weight parts of the above polymer solution was added thereto and dispersed for 1 hour with a three-one motor. After 1 hour, 500 weight parts of water was added to stop the dispersion. The objective average grain size was obtained by appropriately changing the stirring strength. The thus-obtained matting agent emulsion was centrifuged to obtain the matting agent having the grain size distribution shown in Table 1. On the other hand, as a soluble matting agent, poly(methyl methacrylate/methacrylic acid=54/46 (mol ratio)) polymer was used and emulsifying dispersion was carried out in the same manner and a matting agent emulsion was obtained. The number average grain size and grain size distribution of the matting agent obtained here were obtained by taking the electron microphotograph of the matting agent and from which selecting and measuring 600 grain sizes of the matting agent.

4-2) Coating of Light-Sensitive Layer

Next, each layer having the following composition was multilayer coated on the opposite side of the above obtained backing layer and a color negative photographic film was prepared. The matting agent of the present invention was contained in the outermost layer of the light-sensitive layers (the second protective layer).

Composition of Light-Sensitive Layer

The main components for use in each layer are classified as follows:

ExC: Cyan Coupler

ExM: Magenta Coupler

ExY: Yellow Coupler

ExS: Sensitizing Dye

UV: Ultraviolet Absorber

HBS: High Boiling Point Organic Solvent

H: Hardening Agent for Gelatin

The numeral corresponding to each component indicates the coated weight in unit of g/m$^2$ , and the coated weight of silver halide is shown as the calculated weight of silver. Further, in the case of a sensitizing dye, the coated weight is indicated in unit of mol per mol of silver halide in the same layer.

Sample No. 101

| | |
|---|---|
| First Layer: Antihalation Layer | |
| Black Colloidal Silver | 0.09 as silver |
| Gelatin | 1.60 |
| ExM-1 | 0.12 |
| ExF-1 | $2.0 \times 10^{-3}$ |
| Solid Dispersion Dye ExF-2 | 0.030 |
| Solid Dispersion Dye ExF-3 | 0.040 |
| HBS-1 | 0.15 |
| HBS-2 | 0.02 |
| Second Layer: Interlayer | |
| Silver Iodobromide Emulsion M | 0.065 as silver |
| ExC-2 | 0.04 |
| Polyethyl Acrylate Latex | 0.20 |
| Gelatin | 1.04 |
| Third Layer: Slow-Speed Red-Sensitive Emulsion Layer | |
| Silver Iodobromide Emulsion A | 0.25 as silver |
| Silver Iodobromide Emulsion B | 0.25 as silver |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |
| Fourth Layer: Middle-Speed Red-Sensitive Emulsion Layer | |
| Silver Iodobromide Emulsion C | 0.70 as silver |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |
| Fifth Layer: High-Speed Red-Sensitive Emulsion Layer | |
| Silver Iodobromide Emulsion D | 1.40 as silver |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |
| Sixth Layer: Interlayer | |
| Cpd-1 | 0.090 |
| Solid Dispersion Dye ExF-4 | 0.030 |
| HBS-1 | 0.050 |
| Polyethyl Acrylate Latex | 0.15 |
| Gelatin | 1.10 |
| Seventh Layer: Slow-Speed Green-Sensitive Emulsion Layer | |
| Silver Iodobromide Emulsion E | 0.15 as silver |

-continued

| | |
|---|---|
| Silver Iodobromide Emulsion F | 0.10 as silver |
| Silver Iodobromide Emulsion G | 0.10 as silver |
| ExS-4 | $3.0 \times 10^{-5}$ |
| ExS-5 | $2.1 \times 10^{-4}$ |
| ExS-6 | $8.0 \times 10^{-4}$ |
| ExN-2 | 0.33 |
| ExN-3 | 0.086 |
| ExY-1 | 0.015 |
| HBS-1 | 0.30 |
| HBS-3 | 0.010 |
| Gelatin | 0.73 |
| Eighth Layer: Middle-Speed Green-Sensitive Emulsion Layer | |
| Silver Iodobromide Emuision H | 0.80 as silver |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExN-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.80 |
| Ninth Layer: High-Speed Green-Sensitive Emulsion Layer | |
| Silver Iodobromide Emulsion I | 1.25 as silver |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |
| Polyethyl Acrylate Latex | 0.15 |
| Gelatin | 1.03 |
| Tenth Layer: Yellow Filter Layer | |
| Yellow Colloidal Silver | 0.015 as silver |
| Cpd-1 | 0.16 |
| Solid Dispersion Dye ExF-5 | 0.060 |
| Solid Dispersion Dye ExF-6 | 0.060 |
| Oil-Soluble Dye ExF-7 | 0.010 |
| HBS-1 | 0.60 |
| Gelatin | 0.60 |
| Eleventh Layer: Slow-Speed Blue-Sensitive Emulsion Layer | |
| Silver Iodobromide Emulsion J | 0.09 as silver |

-continued

| | |
|---|---|
| Silver Iodobromide Emulsion K | 0.09 as silver |
| ExS-7 | $8.6 \times 10^{-4}$ |
| ExC-8 | $7.0 \times 10^{-3}$ |
| EXY-1 | 0.050 |
| ExY-2 | 0.22 |
| ExY-3 | 0.50 |
| ExY-4 | 0.020 |
| Cpd-2 | 0.10 |
| Cpd-3 | $4.0 \times 10^{-3}$ |
| HBS-1 | 0.28 |
| Gelatin | 1.20 |
| Twelfth Layer: High-Speed Blue-Sensitive Emulsion Layer | |
| Silver Iodobromide Emulsion L | 1.00 as silver |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.70 |
| Thirteenth Layer: First Protective Layer | |
| UV-1 | 0.19 |
| UV-2 | 0.075 |
| UV-3 | 0.065 |
| ExF-8 | 0.045 |
| ExF-9 | 0.050 |
| HBS-1 | $5.0 \times 10^{-2}$ |
| HBS-4 | $5.0 \times 10^{-2}$ |
| Gelatin | 1.8 |
| Fourteenth Layer: Second Protective Layer | |
| H-1 | 0.40 |
| B-1 (insoluble matting agent) | shown in Table 2 |
| B-2 (soluble matting agent) (number average grain size: 0.5 $\mu$m, CV value: 0.98, volume average grain size: 2.3 $\mu$m) | 0.06 |
| B-3 | 0.10 |
| S-1 | 0.20 |
| Water Dispersion of $C_6H_{13}CH(OH)C_7H_{15}COOC_{40}H_{81}$/ $C_{50}H_{101}O(CH_2CH_2O)_{16}H$ = (4/6 by weight ratio) (average grain size: 20 nm) | 0.05 |
| W-1 | 0.015 |
| W-3 | 0.015 |
| F-1 | 0.005 |
| F-17 | 0.005 |
| Colloidal Silica | 0.25 |
| Gelatin | 0.70 |

Silver Iodobromide Emulsions A to M were prepared as shown in Table 1.

TABLE 1

| Emulsion | Average AgI Content (%) | Variation Coefficient of the AgI Content among Grains (%) | Average Diameter Corresponding to Sphere ($\mu$m) | Variation Coefficient of the Grain Size (%) | Projected Area Diameter Corresponding to Circle ($\mu$m) | Diameter/ Thickness Ratio |
|---|---|---|---|---|---|---|
| A | 1.7 | 10 | 0.46 | 15 | 0.56 | 5.5 |
| B | 3.5 | 15 | 0.57 | 20 | 0.78 | 4.0 |
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 20 | 0.78 | 4.0 |
| G | 8.8 | 25 | 0.61 | 23 | 0.77 | 4.4 |

TABLE 1-continued

| Emulsion | Average AgI Content (%) | Variation Coefficient of the AgI Content among Grains (%) | Average Diameter Corresponding to Sphere (μm) | Variation Coefficient of the Grain Size (%) | Projected Area Diameter Corresponding to Circle (μm) | Diameter/ Thickness Ratio |
|---|---|---|---|---|---|---|
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |
| L | 14.0 | 25 | 1.28 | 26 | 1.46 | 3.5 |
| M | 1.0 | — | 0.07 | 15 | — | 1 |

Further, W-1 to W-3, B-4 to B-6, F-1 to F-17, iron salt, lead salt, gold salt, platinum salt, palladium salt, iridium salt and rhodium salt were appropriately included in each layer to improve storage stability, processing properties, pressure resistance, fungicidal and biocidal properties, antistatic properties and coating properties.

Preparation of Dispersion of Organic Solid Dispersion Dye

ExF-2 shown below was dispersed according to the following method. That is, 21.7 ml of water, 3 ml of a 5% aqueous solution of sodium p-octylphenoxyethoxyethoxyethanesulfonate, and 0.5 g of a 5% aqueous solution of p-octylphenoxypolyoxyethylene ether (polymerization degree: 10) were put in a pot mill having a capacity of 700 ml, and 5.0 g of Dye ExF-2 and 500 ml of zirconium oxide beads (diameter: 1 mm) were added thereto and the content was dispersed for 2 hours. The vibrating ball mill which was used was BO type ball mill manufactured by Chuo Koki. The content was taken out after dispersion and added to 8 g of a 12.5% aqueous solution of gelatin and the beads were removed by filtration and the gelatin dispersion of the dye was obtained. The average grain size of fine grains of the dye was 0.44 μm.

Solid dispersions of ExF-3, ExF-4 and ExF-6 were obtained in the same manner. The average grain sizes of fine grains of the dyes were 0.24 μm, 0.45 μm and 0.52 μm, respectively. ExF-5 was dispersed according to the micro-precipitation dispersion method disclosed in Working Example 1 of EP-A-549489. The average grain size was 0.06 μm.

ExC-1

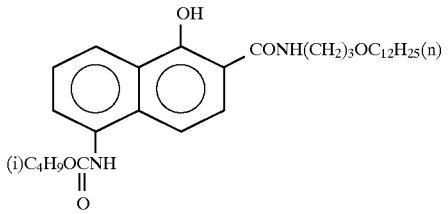

ExC-2

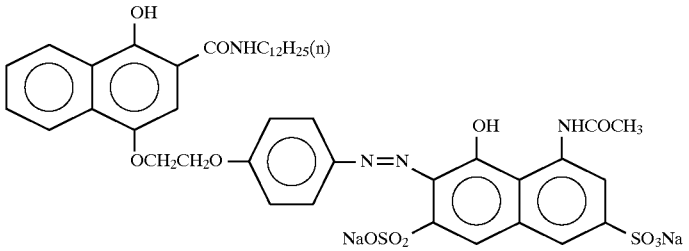

ExC-3

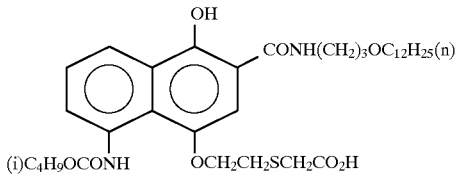

-continued
ExC-4
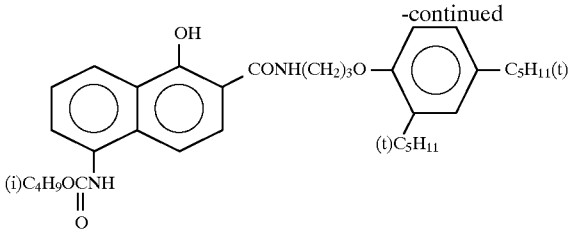
ExC-5
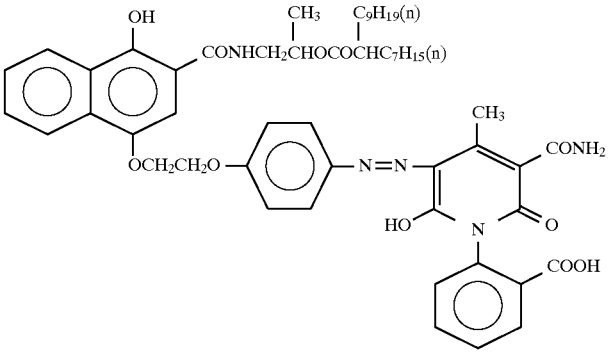
ExC-6
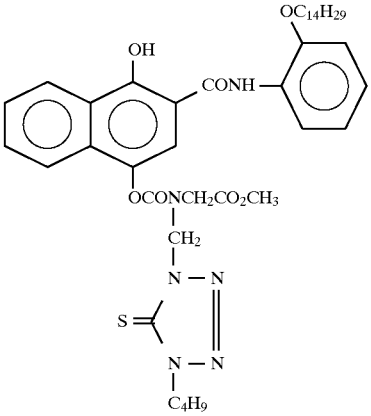
ExC-7
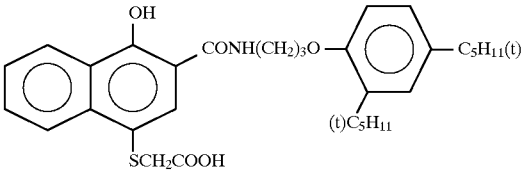
ExC-8
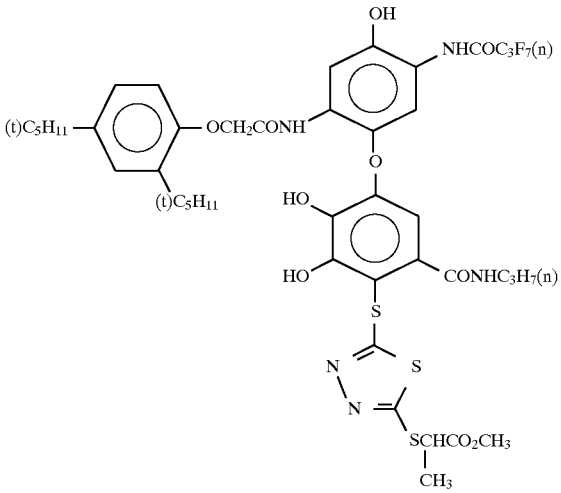

-continued
ExM-1
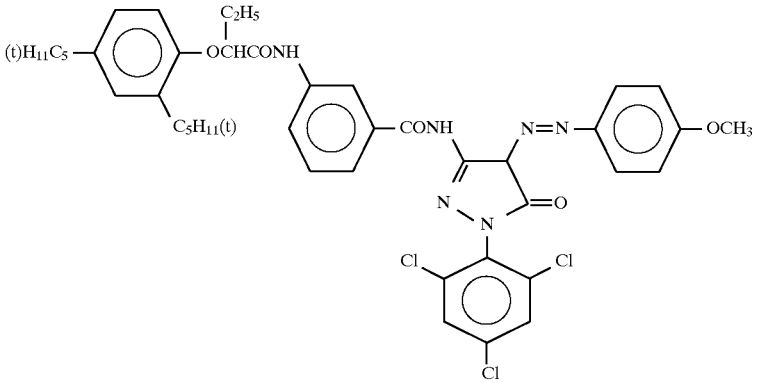
ExM-2
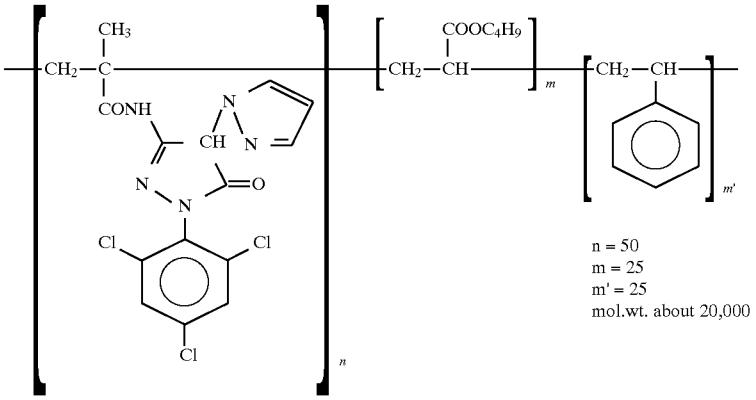
ExM-3
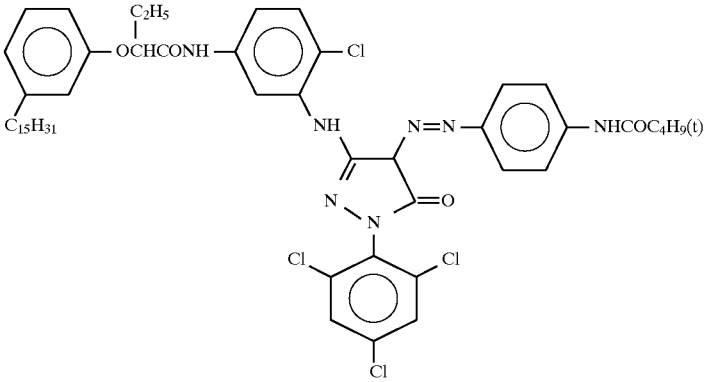
ExM-4
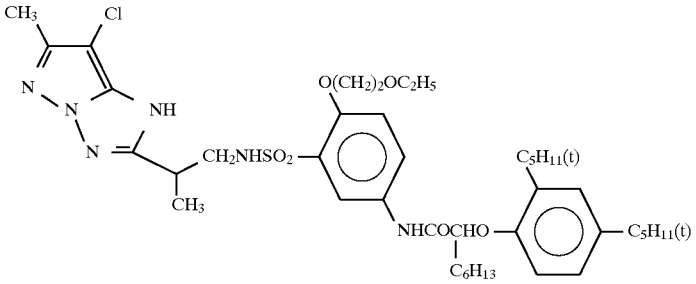

-continued
ExM-5
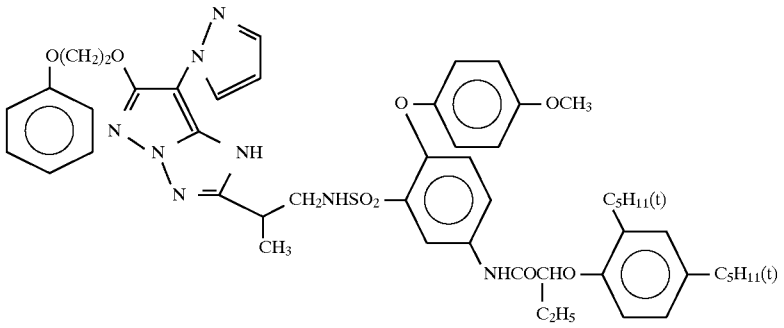
ExY-1
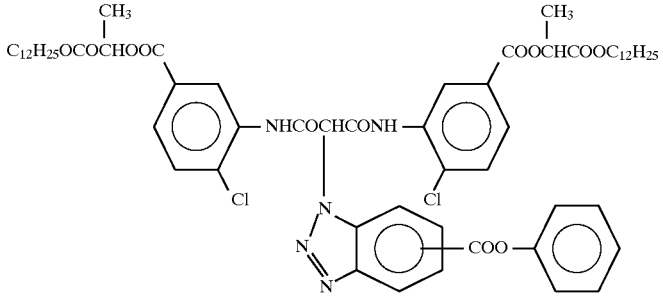
ExY-2
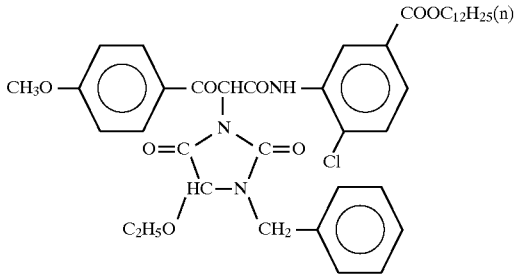
ExY-3
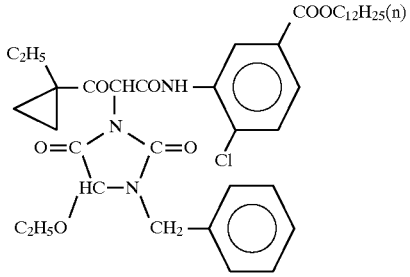
ExY-4
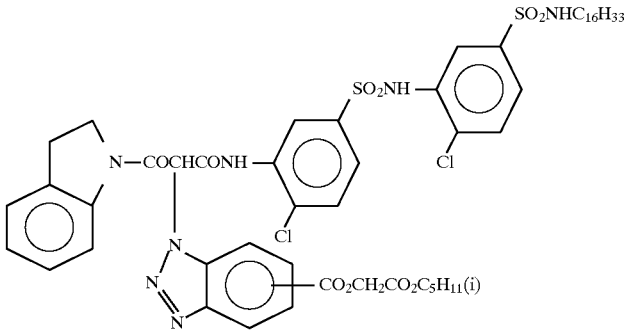

-continued
ExY-5
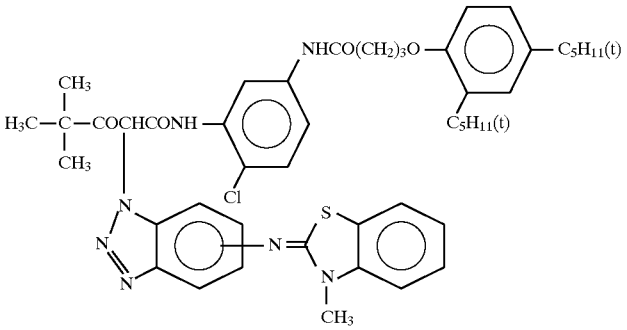
ExF-1
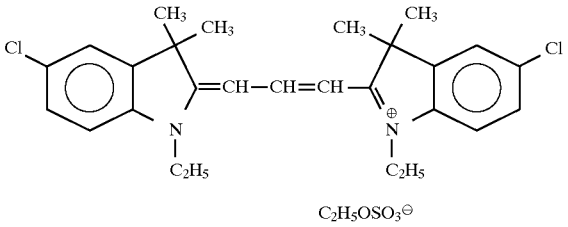
ExF-2
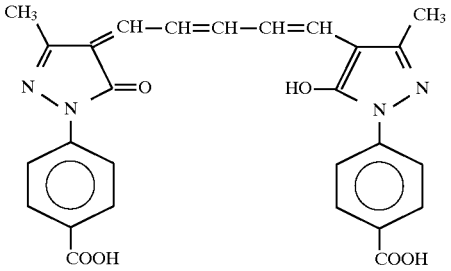
ExF-3
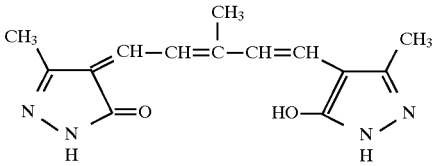
ExF-4
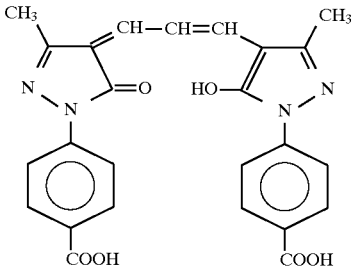
ExF-5
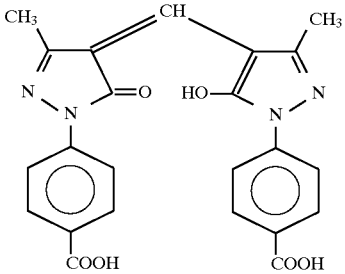

-continued
ExF-6
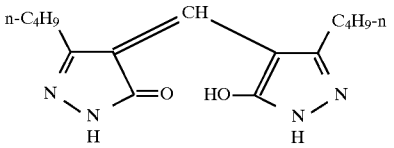
ExF-7
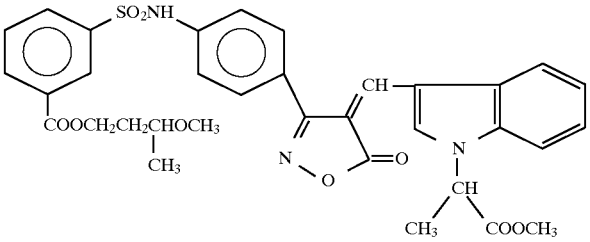
ExF-8
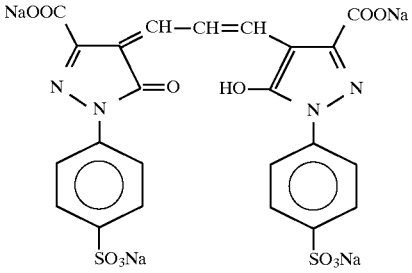
ExF-9
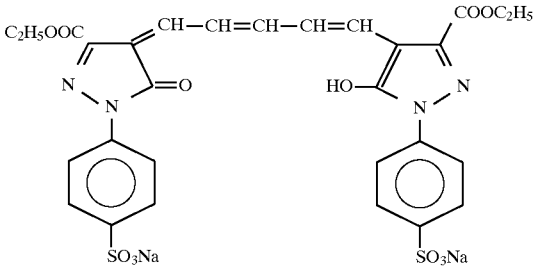
Cpd-1
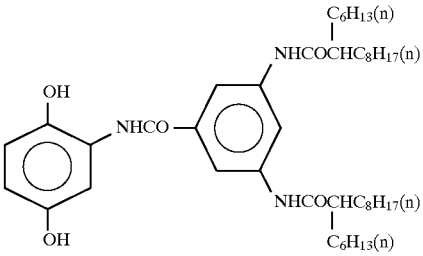
Cpd-2
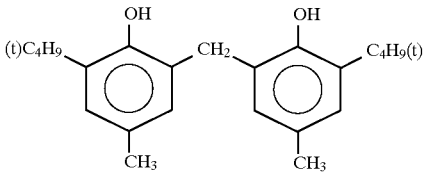
Cpd-3
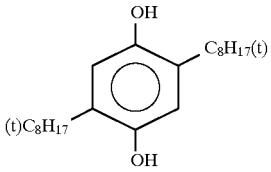

-continued
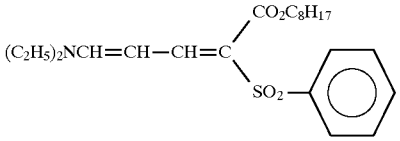
UV-1
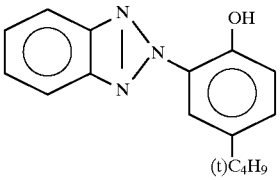
UV-2
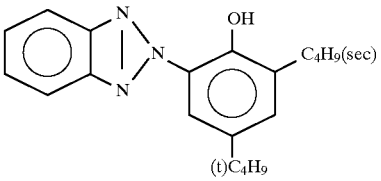
UV-3
Tricresyl Phosphate HBS-1
Di-n-butyl Phthalate HBS-2
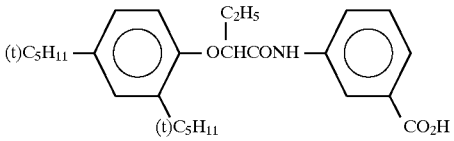
HBS-3
Tri(2-ethylhexyl) Phosphate HBS-4
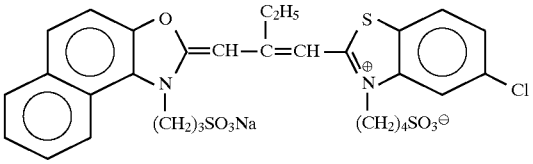
ExS-1
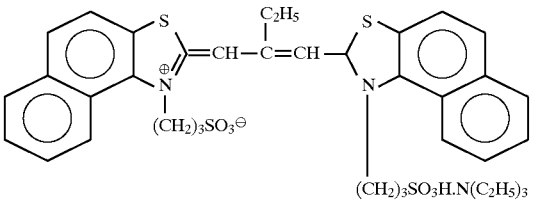
ExS-2
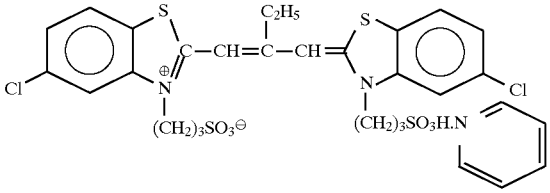
ExS-3
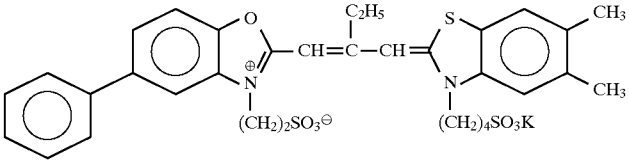
ExS-4

-continued
ExS-5
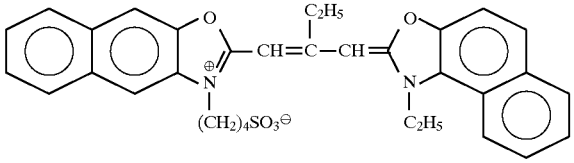
ExS-6
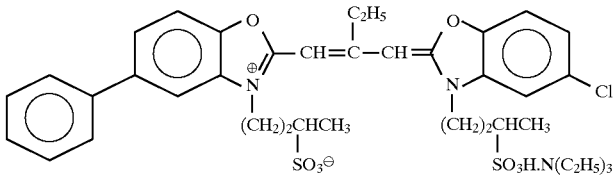
ExS-7
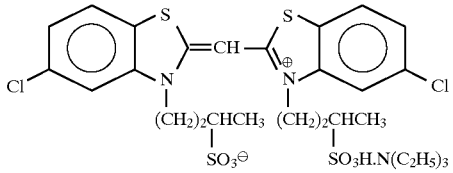
S-1
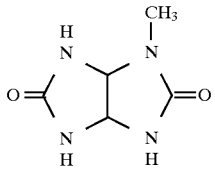
H-1
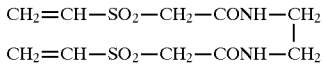
B-1
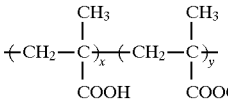
B-2
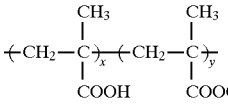
x/y = 46/54
B-3
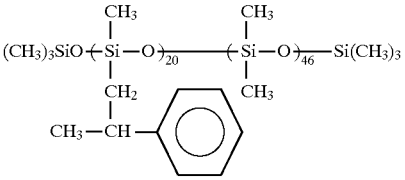
B-4
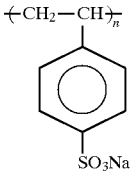
B-5
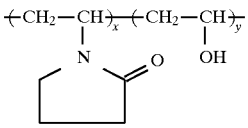
x/y = 70/30
B-6
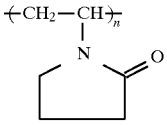
(mol. wt. 10,000)

-continued
W-1
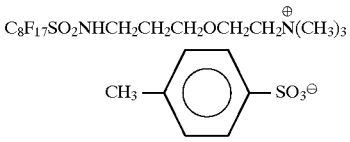
W-2
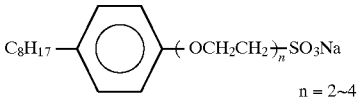
W-3
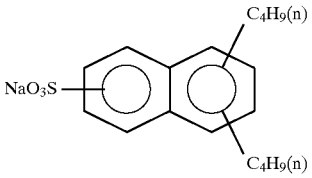
F-1
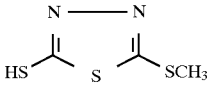
F-2
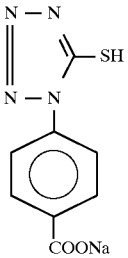
F-3
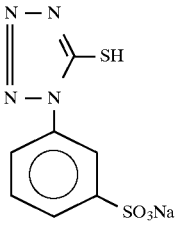
F-4
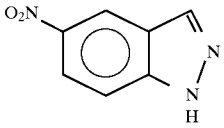
F-5
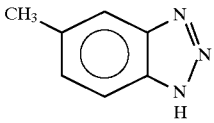
F-6
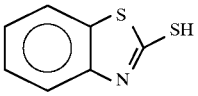
F-7
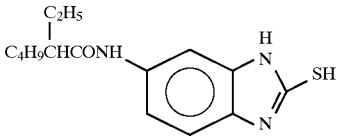

-continued

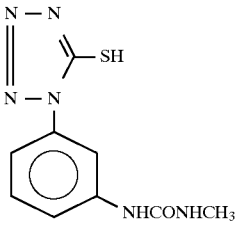

F-8

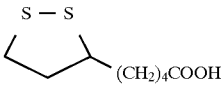

F-9

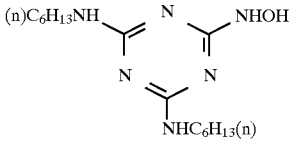

F-10

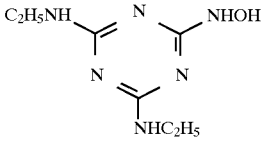

F-11

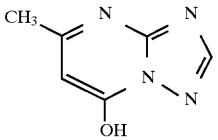

F-12

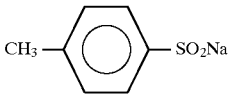

F-13

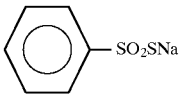

F-14

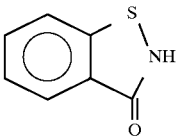

F-15

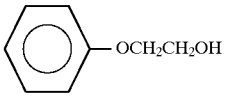

F-16

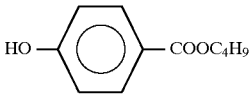

F-17

The obtained samples were evaluated as follows.

1) Peeling off test of the matting agent

Peeling off of a matting agent by a liquid-squeezing rubber (rubber lips) of a high speed processor for a motion picture film was tested as follows.

Each of the above-obtained samples was immersed in the above color developing solution (38° C.) for 5 minutes, then the surface of the sample was rubbed with a 12 mm CN-16 rubber lips for motion picture development with applying a load of 200 g. Rubbing was repeated ten times at the speed of 1.8 m/min. The sample was washed and dried, then the surface was observed with SEM and the degree of scrapes (i.e., scratches) on the surface was evaluated. ⊚: there is absolutely no change, o: a trace amount of changes are observed but are negligible, Δ: scrapes are observed slightly but are within tolerance, x: scrapes are observed, and xx: scrapes are conspicuous. ⊚ to Δ are practicable.

2) Adhesion resistance test

Samples were development processed in a usual method with a suspending type processor, then cut to a square of 35 mm×35 mm and allowed to stand in the atmosphere of 25° C., 85% RH for 2 hours, then the emulsion face and the back face were overlapped and sealed and stored at 40° C. for 24 hours with applying a load of 500 g. Then, the films were peeled and the marks of adhesion were visually evaluated. ⊙: there is no mark of adhesion, o: marks are faintly observed but are negligible, Δ: marks are observed a little but are within tolerance, x: marks are observed considerably, and xx: marks are observed conspicuously. ⊙ to Δ are practicable.

As is apparent from the results in Table 2, the matting agents containing from 5 to 15% of acid amount and having a variation coefficient of grain size of 0.3 or less do not generate peeling off and are excellent in adhesion resistance.

In place of the above used PEN base, using a base which was not subjected to 110° C., 48 hour heat treatment, a base of 95 μm thick polyethylene terephthalate (PET), and a base of triacetyl cellulose (TAC) having a thickness of 115 μm, the same light-sensitive layers and backing layers were coated, and each sample was evaluated.

One meter of the film slit to a width of 35 mm was strongly wound on to the pole of brass having a diameter of 7 mm and fixed and allowed to stand for 10 days at 50° C., then freed and the curled diameter was measured. ⊙: 14 mm or more, o: from 14 mm to 12 mm, Δ: from 12 mm to 10 mm, x: from 10 mm to 8 mm, and xx: 8 mm or less. Δ and o are practicable.

The results of the above evaluation are shown in Table 2 below.

Further, the following experimetmation was carried out for Samples A, G, H, I, J and K which were shown in Table 2.

Each of the samples was slit to obtain the slit products having a width of 24 mm and a length of 10 m.

The obtained silt products each was run with a speed of 300 mm/sec using the permalloy head having a head gap of 5 μm, a track width of 1 mm and a winding number of 50 to magnetic-record a FM signal with a wavelength of 30 μm, and then was subjected to the mothion picture development with the same formulation of the processing solution for the development processing as described below to obtain the wound samples.

The development processing was conducted according to the following method.

| | |
|---|---|
| Color Development | 3 min 15 sec |
| Bleaching | 6 min 30 sec |
| Washing | 2 min 10 sec |
| Fixing | 4 min 20 sec |
| Washing | 3 min 15 sec |
| Stabilization | 1 min 05 sec |

The composition of the processing solution used in each processing was as follows.

| | |
|---|---|
| Color Developing Solution | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 g |
| Hydroxylamine Sulfate | 2.4 g |
| 4-(N-Ethyl-N-β-hydroxyethylamino)-2-methylaniline Sulfate | 4.5 g |
| Water to make | 1.0 l |
| pH | 10.0 |
| Bleaching Solution | |
| Ammonium Ethylenediaminetetraacetato Ferrate | 100.0 g |
| Disodium Ethylenediaminetetraacetate | 10.0 g |
| Ammonium Bromide | 150.0 g |
| Ammonium Nitrate | 10.0 g |
| Water to make | 1.0 l |
| pH | 6.0 |
| Fixing Solution | |
| Disodium Ethylenediaminetetraacetate | 1.0 g |
| Sodium Sulfite | 4.0 g |
| Aqueous Ammonium Thiosulfate Solution (70%) | 175.0 g |
| Sodium Bisulfite | 4.6 g |
| Water to make | 1.0 l |
| pH | 6.6 |
| Stabilizing Solution | |
| Formalin (40%) | 2.0 ml |
| Polyoxyethylene-p-monononylphenyl Ether (average polymerization degree: 10) | 0.3 g |
| Water to make | 1.0 l |

The thus-obtained samples each was measured with respect to the magnetic output by running with a speed of of 300 mm/sec using the permalloy head having a head gap of 2.5 μm, a track width of 0.35 mm and a winding number of 2000 to obtain the generation frequency of dropout after the continuous 10 passes or more.

The results are shown in Table 3 below.

As is apparent from the results of Table 3, when the amount of acid in the matting agent is decreased, the frequency of dropout generated in the magnetic output is increased.

TABLE 2

| | Support | | Insoluble Matting Agent (B-1) | | | | | Performance | | | |
|---|---|---|---|---|---|---|---|---|---|---|---|
| Samples | Composition | Heat Treatment 110° C. 24 hrs. | Grain Size (μm) | Variation Coefficient | Amount of Acid (M-3) (mol) | Coating Amount (mg/m²) | Peeling Off | Adhesion Resistance | Curling | Remarks |
| A | PEN | yes | 2.4 | 0.05 | 10 | 60 | ⊙ | ⊙ | ⊙ | Invention |
| B | PEN | yes | 2.4 | 0.09 | 10 | 60 | ⊙ | ⊙ | ⊙ | Invention |
| C | PEN | yes | 2.1 | 0.18 | 10 | 60 | o | ⊙ | ⊙ | Invention |
| D | PEN | yes | 2.4 | 0.30 | 10 | 60 | o-Δ | ⊙ | ⊙ | Invention |
| E | PEN | yes | 2.3 | 0.46 | 10 | 60 | Δ-x | ⊙ | ⊙ | Comparison |
| F | PEN | yes | 2.4 | 1.03 | 10 | 60 | x | ⊙ | ⊙ | Comparison |
| G | PEN | yes | 2.4 | 0.18 | 0 | 60 | xx | ⊙ | ⊙ | Comparison |
| H | PEN | yes | 2.4 | 0.17 | 3 | 60 | Δ-x | ⊙ | ⊙ | Comparison |
| I | PEN | yes | 2.3 | 0.20 | 5 | 60 | o-Δ | ⊙ | ⊙ | Invention |

TABLE 2-continued

| | Support | | Insoluble Matting Agent (B-1) | | | | | | | |
|---|---|---|---|---|---|---|---|---|---|---|
| | | Heat Treatment | Grain | | Amount of Acid | Coating | Performance | | | |
| Samples | Composition | 110° C. 24 hrs. | Size (μm) | Variation Coefficient | (M-3) (mol) | Amount (mg/m²) | Peeling Off | Adhesion Resistance | Curling | Remarks |
| J | PEN | yes | 2.4 | 0.19 | 10 | 60 | ◎ | ◎ | ◎ | Invention |
| K | PEN | yes | 2.2 | 0.18 | 15 | 60 | ◎ | ○ | ◎ | Invention |
| L | PEN | yes | 2.4 | 0.20 | 20 | 60 | ◎ | x | ◎ | Comparison |
| M | PEN | yes | 2.2 | 0.16 | 40 | 60 | ◎ | xx | ◎ | Comparison |
| N | PEN | no | 2.1 | 0.18 | 10 | 60 | ○ | ◎ | ○-Δ | Invention |
| O | PET | no | 2.1 | 0.18 | 10 | 60 | ○ | ◎ | Δ | Invention |
| P | TAC | yes | 2.1 | 0.18 | 10 | 60 | ◎ | ◎ | ○-Δ | Invention |
| Q | TAC | no | 2.1 | 0.18 | 10 | 60 | ◎ | ◎ | Δ | Invention |
| R | PEN | yes | 2.1 | 0.18 | 8<br>12 | 30<br>30 | ◎ | ◎ | ◎ | Invention |

TABLE 3

| Samples | Amount of Acid of Matting Agent (%) | Frequency of Dropout (%) | Remarks |
|---|---|---|---|
| A | 10 | 0.01 | Invention |
| G | 0 | 0.21 | Comparison |
| H | 3 | 0.14 | Comparison |
| I | 5 | 0.02 | Invention |
| J | 10 | 0 | Invention |
| K | 15 | 0.01 | Invention |

EFFECT OF THE INVENTION

According to the present invention, silver halide photographic materials which are free of peeling off of a matting agent in motion picture development processing and excellent in development processing suitability can be obtained.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having thereon at least one silver halide emulsion layer, wherein the photographic material contains a monodispersed polymer in an amount of from 2 to 300 mg/m² and having a number average grain size of from 0.3 to 10 μm and a variation coefficient thereof of 0.30 or less and containing from 5 to 15 mol % of an acid monomer, wherein at least one entirely transparent magnetic recording layer is provided on the surface of the support opposite to the side on which the silver halide emulsion layer is provided.

2. The silver halide photographic material as claimed in claim 1, wherein said acid monomer is acrylic acid or methacrylic acid.

3. The silver halide photographic material as claimed in claim 1, wherein said support comprises polyethylene-2,6-naphthalenedicarboxylate.

4. The silver halide photographic material as claimed in claim 1, wherein said support is heat-treated at from Tg to Tg minus 50° C., and the thickness thereof is from 50 to 300 μm.

5. The silver halide photographic material as claimed in claim 1, wherein the variation coefficient of the number average grain size of said polymer is 0.1 or less.

6. The silver halide photographic material as claimed in claim 1, wherein the photographic material is processed to a roll state and photographed and developed.

7. The silver halide photographic material as claimed in claim 1, wherein the tip of the silver halide photographic material wound onto a spool capable of revolving freely provided within the body of a patrone is sent outside through the port of the patrone by revolving the axle of the spool in the feeding direction of the film.

8. The silver halide photographic material as claimed in claim 1, wherein said polymer has a number average grain size of from 1.5 to 4.0 μm.

9. The silver halide photographic material as claimed in claim 1, wherein the polymer has a number average grain size of from 1.5 μm to 2.9 μm.

10. The silver halide photographic material as claimed in claim 1, wherein the acid monomer is contained in an amount of from 7 to 12 mol %.

11. The silver halide photographic material as claimed in claim 1, wherein the polymer is a methyl methacrylate/methacrylic acid copolymer having a 95/5 to 85/15 methyl methacrylate/methacrylic acid mol ratio.

* * * * *